US010532443B2

(12) United States Patent
Junker

(10) Patent No.: US 10,532,443 B2
(45) Date of Patent: Jan. 14, 2020

(54) METHOD AND GRINDING MACHINE FOR GRINDING GROOVED WORKPIECES

(71) Applicant: Erwin Junker Maschinenfabrik GmbH, Nordrach (DE)

(72) Inventor: Erwin Junker, Buehl/Baden (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 194 days.

(21) Appl. No.: 15/554,027

(22) PCT Filed: Mar. 11, 2016

(86) PCT No.: PCT/EP2016/055221
§ 371 (c)(1),
(2) Date: Aug. 28, 2017

(87) PCT Pub. No.: WO2016/146495
PCT Pub. Date: Sep. 22, 2016

(65) Prior Publication Data

US 2018/0043503 A1 Feb. 15, 2018

(30) Foreign Application Priority Data

Mar. 18, 2015 (DE) ..... 10 2015 204 909

(51) Int. Cl.
*B24B 49/00* (2012.01)
*B24B 49/16* (2006.01)
(Continued)

(52) U.S. Cl.
CPC ..... *B24B 49/006* (2013.01); *B24B 19/022* (2013.01); *B24B 49/16* (2013.01); *B24B 49/18* (2013.01); *B24B 53/07* (2013.01)

(58) Field of Classification Search
CPC ..... B24B 19/022; B24B 49/006; B24B 49/16; B24B 49/18; B24B 53/04; B24B 53/053;
(Continued)

(56) References Cited

U.S. PATENT DOCUMENTS 2,446,105 A 7/1948 Polk
2,689,434 A 9/1954 Grobey
(Continued)

FOREIGN PATENT DOCUMENTS

EP 2106879 A1 10/2009
GB 715247 A 9/1954
GB 764510 A 12/1956

OTHER PUBLICATIONS

International Search Report for International Application No. PCT/EP2016/055221, dated Jun. 3, 2016.

*Primary Examiner* — Timothy V Eley
(74) *Attorney, Agent, or Firm* — Marshall, Gerstein & Borun LLP

(57) ABSTRACT

A method is disclosed for grinding grooves on workpieces using a profiled grinding wheel, the profile of which is crushed. A reshaping crush process includes driven crush rollers, each being controlled on the basis of a rotational speed and current consumption. Thus, relative advancement between the grinding wheel and crush roller is controlled according to the speed and current consumption. A grinding machine is also disclosed for grinding a workpiece, wherein the workpiece is held by means of a workpiece spindle head. A crush device comprising a crush roller with a dedicated rotary drive is provided on the grinding machine. The grinding wheel is applied to the crush roller in order to dress the grinding wheel profile. The crush roller has a profile-crushing portion for profile-crushing the grinding wheel with a first dressing volume and a reshaping profile-crushing
(Continued)

portion for profile-crushing the grinding wheel with a second dressing volume.

22 Claims, 7 Drawing Sheets

(51) Int. Cl.
*B24B 53/07* (2006.01)
*B24B 19/02* (2006.01)
*B24B 49/18* (2006.01)

(58) Field of Classification Search
CPC ..... B24B 53/06; B24B 53/062; B24B 53/065; B24B 53/07

See application file for complete search history.

(56) References Cited

U.S. PATENT DOCUMENTS 2,877,758 A 3/1959 Fassnacht et al.
3,424,566 A * 1/1969 Kuenstle ..... B24B 53/00 125/11.03
4,151,684 A * 5/1979 Wada ..... B24B 49/18 125/11.01
4,557,078 A * 12/1985 Brill ..... B24B 53/053 125/11.03
4,628,643 A * 12/1986 Gile ..... B24B 49/16 451/21
4,924,842 A * 5/1990 Rao ..... B24B 49/16 125/11.01
6,113,474 A * 9/2000 Shih ..... B24B 53/053 451/14
6,361,412 B1 3/2002 Kaiser
8,771,043 B2 * 7/2014 Sakakibara ..... B24B 53/14 125/11.03
10,183,372 B2 * 1/2019 Lewis ..... B23G 5/00

* cited by examiner

METHOD AND GRINDING MACHINE FOR GRINDING GROOVED WORKPIECES

CROSS-REFERENCE TO RELATED APPLICATIONS

This is the United States national phase of International Patent Application No. PCT/EP2016/055221, filed Mar. 11, 2016, which claims the benefit of priority of DE 10 2015 204 909.4, filed Mar. 18, 2015, the entire contents of which are hereby incorporated herein by reference.

FIELD OF THE DISCLOSURE

The present disclosure refers to a method for grinding grooved workpieces.

BACKGROUND

In known methods and grinding machines for grinding grooves on workpieces, wherein in particular helically grooved or threaded workpieces are produced, the grinding wheel is profiled so that during grinding of groove into the workpiece, the outer positive form of profiling of the grinding wheel is generated as a negative formed groove in the workpiece. Even by using high performance and relatively durable CBN or diamond grinding wheels, the wear on the profile of the grinding wheel causes a deterioration of grinding result and correspondingly to a deviation from the nominal shape of groove in the workpiece, wherein during the grinding process also precision of profiling of the grinding wheel and sharpness decrease. Therefore, the profiling of the grinding wheel has to be newly profiled after a determined usage, i.e. it has to be dressed.

As a very efficient dressing method for profiling of above said grinding wheels, crushing has gained widespread acceptance. Crushing, which is frequently also called roll-in profiling, is a particular, accepted and appreciated method for rotational dressing for reproduction-precise profiling of metal or ceramic bonded diamond or CBN grinding wheels. Crushing is particularly used when precisely profiled tools have to be provided in large quantities.

Known crushing devices usually have crushing rollers, which are either driven and drive the grinding wheel by friction, when both are engaged to each other, or not driven, wherein the grinding wheel is driven, so that, when both are engaged to each other, the grinding wheel drives the crushing rollers by friction, i.e. by rotating the same. Due to a recent trend towards ever larger and more powerful grinding machines with powerful grinding spindle drives, driving of crushing rollers by means of driven grinding wheel has found increasing acceptance, i.e. the crushing roller is moving smoothly therewith, when the grinding wheel is engaged with the crushing roller. In order to achieve a high profiling precision on the grinding wheel, the crushing parameters have to be selected and applied with great care. Indeed, when crushing roller and grinding wheel are engaged to each other, either whole grains from the profiling coating of the grinding wheel or at least larger debris thereof are crushed or even ripped out. During crushing, care has also to be taken that the ripped grains are removed as fast as possible from the contact area between the crushing roller and the grinding wheel. The crushing process takes place at relative high pressures in the engagement area of crushing roller and grinding wheel, so that by possible deformations of the grinding wheel the profile to be formed is distorted during or after dressing. The parameters of the crushing roller and grinding wheel in a stricter sense or of the crushing roller spindle and grinding wheel spindle in a more general sense have therefore to be selected and applied so that said deformations are avoided or completely eliminated. If certain parameters, such as for example the relative advancement between grinding wheel and crushing roller, or the crushing pressure formed in the engagement area, is too large, a so-called rattling may occur, which has to be always avoided during the crushing process.

In DE 30 50 373 C2, a truing device for a numerically controlled profiling and planing machine is described. In this known truing device, a crushing device is positioned on the profiling or planing machine, which has its own drive. The truing of a plurality of profiled grinding wheels is provided, which are positioned one beside the other along their rotation axis, so that each profiled grinding wheel is associated to a truing roller. During the crushing, the truing roller is rolled under pressure over the grinding wheel, so that the grinding grains are crushed and broken free, wherein the peripheral speed of the grinding wheel and of the crushing roller are equal. Due to the truing roller for crushing directly positioned on the known grinding machine, the truing may be already integrated in the whole grinding process.

In DE 1 284 867 A, a universal grinding machine with a turret head is described, on which in its grinding spindle stock a so-called roll-in device is provided, with which the profile required for forming or plunge-cut grinding is rolled over the periphery of a grinding machine. The performing of the roll-in process in the sense of a profiling by crushing is not described. The profiling of the grinding wheel by this known roll-in device is performed, in fact, on the same grinding machine, although it is additionally performed between grinding operations or turning, drilling, rubbing and threading operations also performed on the universal grinding machine, in one single step.

In U.S. Pat. No. 4,555,873, a method and a device for grinding of workpieces by means of a profiled grinding wheel are described. On the grinding machine a truing device is also provided, with which form and sharpness of the grinding wheel may be restored. To this end, the grinding wheel's form and sharpness are restored by truing rollers, whose forms correspond to profiling of the grinding wheel between proper grinding operations. In this document, it is also described that the truing may be also performed during an interruption of the grinding process or even during the grinding, in a continuous manner. This document does not provide direct indications about a crushing, although it describes that the truing has to be considered as a process, which may be continuous or discontinuous. Methodological separations of the truing process are not described.

DE 41 04 266 A1 also describes a truing machine for profiling of a grinding wheel with a truing wheel. The described truing of the grinding wheel, i.e. the generation of the profiling of the grinding wheel required for precision of the grinding result is performed by truing wheels, which are rounded on their front sides, which wheels are spatially tilted around the front side of the grinding wheel during truing, in such a way that the required profile is achieved on the grinding wheel. The truing wheel is oscillating during the truing process about a respective tilting axis which is arranged at a distance from its respective peripheral front side and is transversal to the rotational axis. The truing wheel is essentially moved onto the grinding wheel. In this known truing machine the wear of the truing wheel has to be controlled.

JP 05138532 A provides a truing device for CBN grinding wheels, which dress the grinding wheel so that it may be used both for pre-grinding and finishing. The truing wheel has so called crushing grains and single abrasive grains, which are mixed in the truing coating. The truing is performed in one step and comprises the truing from axial front sides of a cup-shaped grinding wheel.

U.S. Pat. No. 3,435,814 already describes a crushing device for crushing of profiled grinding wheels, which are fixed on a grinding machine. The crushing device has the form of a crushing roller and is placed on the grinding wheel for truing the same. A drive for the crushing roller has to ensure that the peripheral speed of the crushing roller and of the grinding wheel are identical. When the crushing roller and the grinding wheel are engaged to each other, only the grinding wheel drives the crushing roller. The crushing process is performed in one step, and the crushing roller is subsequently separated from the grinding wheel.

The company brochure of Saint Gobain Abrasives also describes how a roll-in device for truing of a profiled grinding wheel should be part of the machine and be fixedly mounted on the same. A time-consuming tool replacement may therefore be avoided. The grinding wheel has to be preferably driven and the profiled roller should be smoothly driven by the same during truing. For first profiling as well as for subsequent profiling processes, specific profile rollers are required. In this known device, it is required that after the pre-profiling, the profiling rollers are replaced. This is disadvantageous in that positioning errors and profiling errors may occur on the grinding wheel.

All of the already-described truing or crushing methods and devices have in common that the crushing may neither be performed for a specific grinding task nor the parameters ensuring a high flexibility of the crushing process itself may be taken into account.

GENERAL DESCRIPTION

The object of the present invention is therefore to provide a method and a grinding machine for grinding grooved workpieces, in which the crushing of a grinding wheel to be profiled is integrated, by taking into account essential crushing parameters, into an automatized grinding process, and a high quality of the grinded workpiece may be achieved, also ensuring a long working life of the grinding wheel.

According to a first aspect of the invention, a method for grinding grooved workpieces is described. The workpieces are in particular helically grooved or threaded workpieces, wherein the grooves may also be straight grooves or radially surrounding grooves such as recesses. The workpiece is clamped and its groove is grinded by a grinding wheel, which has a profiling, which corresponds to the cross section of the groove. During the grinding process, due to wear of the grinding wheel, its profiling may vary, whereby the grinding wheel has to be reshaped by crushing. A reshaping in this context is a finishing crushing or finishing profiling. The profile is provided on the grinding wheel and its precision and sharpness are restored. According to the invention, a reshaping-crushing of the grinding wheel is performed by a crushing roller, which is also driven, in particular by controlling the same, depending on a measurement of rotational speed and current absorption of respective drive of grinding wheel and crushing roller, based on which a relative advancement is performed during crushing between the grinding wheel and the crushing roller. The relative advancement is preferably selected so that, due to efficiency considerations during crushing and the entire grinding process, the relative advancement is a maximum relative advancement, for which no disadvantageous process conditions arise yet. The reshaping-truing is therefore always performed at the maximum relative advancement, for which, on one side, the working life of crushing roller is not excessively reduced, although a relative high crushing pressure may be applied between the crushing roller and the grinding wheel, wherein during crushing, stable crushing conditions are always maintained.

According to the invention, at least speed and current consumption are measured as essential crushing parameters for reshaping-truing and are used for controlling the crushing process. The current consumption defines the power which is drawn, according to requirements, by drives, both for the grinding wheel and the crushing roller or the power to be provided to the same, in order to satisfy the desired defined crushing parameters.

Preferably, the profiling-crushing of the grinding wheel is performed by a crushing roller, which usually is not driven, in particular by controlling only the grinding wheel drive based on its measured rotational speed and current consumption, wherein the profiling-dressing is performed before starting the grinding process. A profiling-crushing means in particular that a still unshaped grinding wheel in a first step before starting the grinding process proper is profiled by a crushing roller, in order for the grinding wheel to grind grooves into the workpiece. Profiling-crushing corresponds to a pre-truing or pre-profiling or rough profiling.

The profiling-crushing is preferably performed by the same crushing roller which is used for the reshaping-crushing process. This is achieved in that the crushing roller has a plurality, preferably at least two, profile grooves, which are used as a negative form for generating the positive profiling on the grinding wheel, in succession. The provision of a plurality of crushing grooves in the crushing roller is advantageous in that a single crushing roller may be used for a plurality of crushing processes. In any case, a crushing roller is so to speak processed in a groove-to-groove manner. And only when the last crushing groove does not allow a further profiling of the grinding wheel, in particular in the course of the reshaping-crushing process, for precision reasons, the crushing roller has to be replaced and possibly machined again.

Also during profiling-crushing, the measurement of speed and current consumption of drive of the grinding wheel allows an optimal crushing by a maximum relative advancement, for which disadvantageous process conditions such as rattling, are avoided.

During profiling-crushing, a greater truing volume is trued from the grinding wheel with respect to reshaping-crushing process.

It is to be noted that during profiling-crushing, the grinding wheel is driven, whereas the crushing roller is usually not driven. During crushing of the driven crushing roller however, due to slippage, and other influences, the same may experience a reduction of speed. To this end the crushing roller's drive is activated, at least for short intervals, so called pulses. The pulses of drive activation, however, last, or are performed, only until the crushing roller has again reached the nominal speed, which is the rotational speed of the grinding wheel.

Usually, with a first groove profile flank the first side of profiling on the grinding wheel is approached, wherein by an already present approach sensor and optional activation of the drive in the form of a drive pulse on the crushing roller, the approaching to the first groove profile flank is monitored. Then, the approaching to a second flank of the groove in the crushing roller occurs, wherein also through the approach sensors, the optional activation of a drive pulse on the crushing roller is monitored. Then a lateral displacement of the grinding wheel occurs until the grinding wheel is moved to the profile center of the groove in the crushing roller. Then the feed motion between the grinding wheel and the crushing roller occurs, i.e. the relative feeding between grinding wheel and crushing roller, wherein the grinding wheel is driven and the crushing roller is freely moving with the same. The maximum relative advancement, i.e. the admissible advancement during the crushing, is provided by monitoring the current consumption and the consequent grind spindle power, wherein the current consumption is continuously measured. The CNC control then calculates and sets the maximum relative advancement, i.e. an optimal advancement between the crushing roller and the grinding wheel, with respect to the efficiency of the crushing process.

When the grinding wheel has obtained its profiling during the profiling crushing, then in the normal grinding process for grinding of the corresponding groove it can inserted or reinserted in the workpiece or again reshaped-crush dressed for increasing precision. Since during grinding the grinding wheel wears out, although the profile form is kept essentially within strict limits, between grinding portions, to be determined, in particular based on the wear rate of profiling of the grinding wheel, the grinding wheel has to be crush dressed in the course of the reshaping. A profiling-dress crushing can therefore be omitted in this process phase.

During the reshaping and crushing, both the grinding wheel and the crushing roller are driven. Also, as in the profiling-crushing, initially a flank of the groove is approached by the crushing roller, wherein through the approaching sensors and measurement of power consumption on both drives of grinding wheel and crushing roller (grinding spindle/crushing spindle), this process is monitored. This is followed by the movement to the second flank of groove, wherein the approaching sensor and the measurement of the power consumption of both drives of the grinding wheel and crushing roller, i.e. their spindles, this process is monitored. This is followed by a displacement of the grinding wheel to the profile center. This procedure differs from the profiling-crushing in that during profiling-crushing, the grinding wheel and the crushing roller are driven and their speed is adjusted, and additionally the current consumption is respectively monitored.

The speeds of the crushing roller and of the grinding wheel are adapted to each other so that their peripheral speeds during the reshaping-crushing process to a defined depth disposed through the circumferential surface of the crushing roller have a defined ratio to each other. In this way, the crushing process may be performed in a controlled way by keeping the essential process parameters for the reshaping-crushing process. It is also ensured to have an optimal crushing, in particular in consideration of essential process-technological parameters during crushing.

Moreover, preferably, the peripheral surface corresponding to the defined groove depth at a constant ratio of peripheral speeds of the grinding wheel and crushing roller, is in particular continuously varied with respect to its depth in the groove.

In case of already mentioned activation, during profiling-crushing of drive pulses on spindle of crushing roller as it drops below a speed limit, the speed limit is now preferably set or the crushing roller is driven as long as the rotational speed corresponds to the peripheral speed of the grinding wheel at the defined depth of groove in the peripheral surface.

It is particularly important that during the crushing of the grinding wheel, in its run-in area a cooling medium is conveyed with such an intensity that the ripped off grains and friction coating parts are rapidly removed from the engaging area.

The maximum relative advancement, which is dependent on machine and crushing parameters, between the grinding wheel and the crushing roller during crushing, is determined, in the course of "trial and error" processes before the actual crushing and is input and in particular also stored as a threshold value in a machine control.

According to a second aspect of the invention, a grinding machine, which is provided for grinding grooved workpieces, in particular helically grooved or threaded workpieces, is provided, as usual, with a grinding spindle stock, which is movable, under CNC-control, on a cross slide over a machine support, in the direction of the X-axis and Z-axis, and which carries a grinding wheel, which is shaped for grinding the groove, and which is rotationally driven. The grooves may also be straight grooves or recesses. Moreover, the grinding machine has a workpiece spindle stock with a C-axis. The workpiece is held on the grinding machine inside a clamping. Additionally, the grinding machine has a crushing device, fixedly held on the same with a crushing roller with its own rotational drive. The speed of the crushing roller is controlled by a control device. According to the invention, the grinding wheel may be applied onto the crushing roller for truing its profile. The crushing roller has a profiling-crushing portion for profiling-crushing the grinding wheel with a first truing volume and a reshaping-crushing portion on the same crushing roller for reshaping-crushing of the grinding wheel with a second truing volume. By providing both a profiling-crushing portion and a reshaping-crushing portion on one and the same crushing roller, the crushing device may be made relatively simple, and may also be particularly stable, since then the crushing roller is sufficiently stable, due, for example, to a rigid bearing, to avoid deformations during the actual crushing process. These deformations may occur, in theory, due to the high forces exerted during the crushing process, whereby the crushing device with its attachment to the machine bed of the grinding machine has also to be particularly rigid.

The crushing roller is preferably provided with more than two crushing slots or grooves, which, during crushing of the profile of the grinding wheel, may be used, one after the other, until the lust crushing groove during crushing does not allow to recover the required precision and sharpness of the profile of the grinding wheel after crushing. The crushing roller is then to be replaced. By providing a plurality of crushing grooves on one and the same crushing roller, after a groove on the crushing roller is worn, the following groove may be used for reshaping-crushing. This ensures that during the reshaping-crushing a grinding wheel profile may be always provided with an optimal precision. This refers to the reshaping-crushing. The profiling-crushing is applied before grinding when the grinding wheel still does not have a profile corresponding to the workpiece groove to be provided. The profiling-crushing is a so called first profiling. During the entire grinding process on the grinding machine only an optional reshaping-crushing has to be performed according to predetermined cycles, so that both the shape of the profile and the sharpness of the grinding wheel are restored after a determined grinding time.

In order to ensure the stability and rigidity of the crushing device in the or on the grinding machine, the crushing device is preferably positioned inside a stable housing and is fixedly connected with the machine support. In this way, it is possible to reliably absorb the forces generated during crushing and also essentially avoid an elastic deformation of the crushing device during crushing.

The crushing device preferably has a CNC-controlled drive, which is connected through a clutch with the crushing roller for its rotational drive. The crushing roller is preferably made of a high performance high speed cutting steel (HSS) or hard metal. The electric drive has the advantage that it may be reliably released in the case of the profiling-crushing, i.e. moves without being driven, which is particularly the case of the profiling-crushing, since in this case the crushing roller is usually not driven, i.e. moves together with the grinding wheel in case of engagement of the grinding wheel in the groove or slot in the crushing roller. The electric drive of the crushing roller has also the advantage, that in case of a drop of the speed of the crushing roller, the drive may be shortly activated by activation pulses through addition of the driving torque, until the speed of the crushing roller is again equal to the grinding wheel and the crushing roller then moves freely again with the grinding wheel.

The crushing device also preferably has a body sound sensor, with which the engagement contact between the crushing roller and the grinding wheel may be continuously monitored, wherein through the body sound sensor an engagement detecting signal may be sent to the control device, so that the control device may receive a signal about the engagement contact.

The grinding wheel or the grinding spindle with the spindle stock may be preferably provided in a way that it may be applied onto the crushing roller during the reshaping-crushing process and may be moved transversally with respect to the reshaping-crushing portion. During crushing, in fact, a flank of the profile of the grinding wheel is normally initially applied and slightly crushed, followed by the application and slight crushing of the second flank and the central reshaping-crushing performed in the groove.

The crushing roller is preferably in one or two parts. While the monolithic configuration with the provision of a plurality of crushing grooves for multiple crushing of a grinding wheel during an entire grinding process is advantageous with reference to a high rigidity, required for crushing, the form in two parts of the crushing roller is particularly convenient, if only a portion of the crushing roller has to be replaced due to wear, whereas the still intact part may be still be used. Thus, an advantage with respect to flexibility is given.

And finally, the control device is preferably adapted so that a maximum relative advancement between the grinding wheel and the crushing roller may be achieved during crushing, in particular in a way that this maximum relative advancement is smaller than a predetermined machine and process parameters depending threshold value, which may be input in the control device before crushing. This maximum relative advancement has to be separately determined for each workpiece, for each configuration of crushing rollers and grinding wheel and corresponding grinding conditions, including the used grinding coatings and materials of the crushing roller, preferably in the context of "trial and error" experiments.

In the case of the present invention, the teaching is readily available to the skilled in the art, that fundamental process parameters for controlling of this maximum relative advancement, i.e. the maximum admissible advancement, without disadvantageous uncontrollable process conditions arising, may be maintained or provided by the grinding machine. The skilled in the art may determine this threshold during tests, with normal efforts. If this threshold value is determined, the control device may allow to operate very near to this advancement threshold, without exceeding the same. Thus, a rapid and economic crushing of grinding wheels may be performed at high speeds and in completely automatic processes.

BRIEF DESCRIPTION OF THE DRAWINGS

Further advantages, possible applications and details are described in the following with the use of examples in the attached figures. In particular.

DETAILED DESCRIPTION

Figure 1:
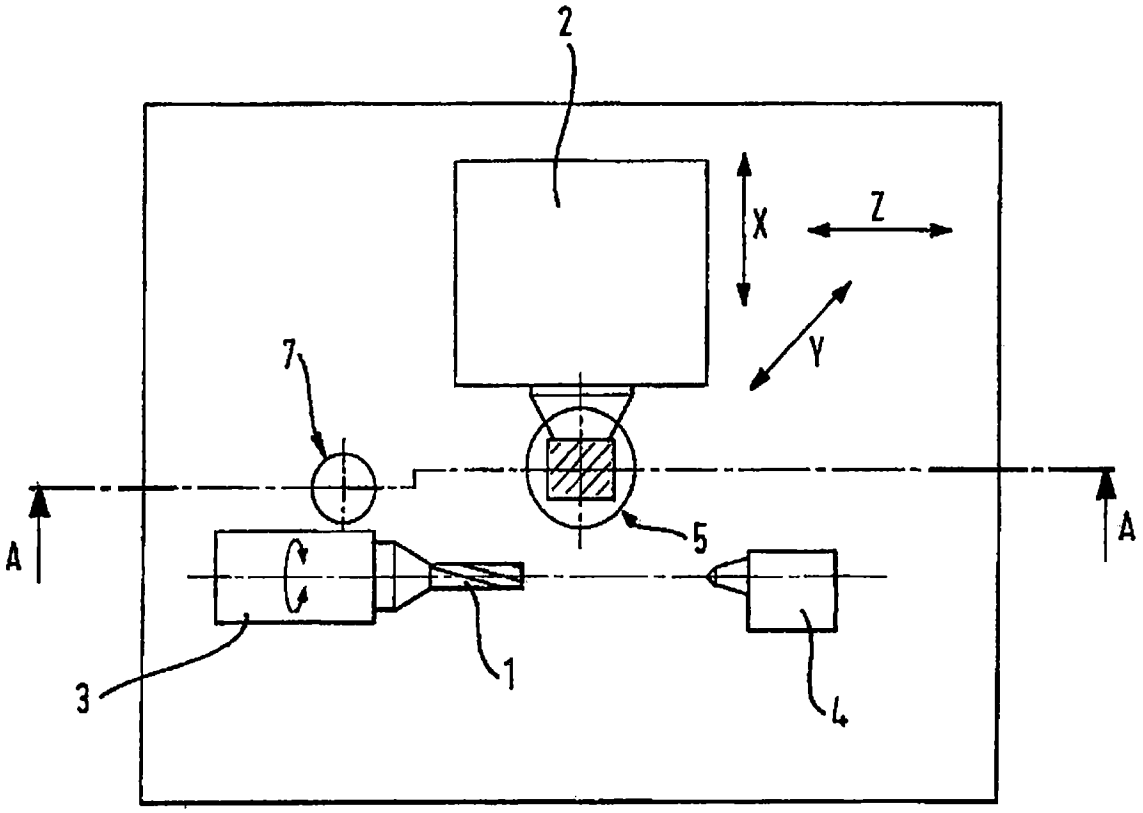
FIG. 1 shows a simplified representation in principle of a grinding machine with a crushing device in a view from above.

In FIG. 1, a representation in principle, from above, of the arrangement of main components of an inventive grinding wheel on the machine bed is shown. A workpiece spindle stock with a workpiece spindle with a C-axis has a workpiece 1 clamped. For an optional clamping of workpiece on points, in the extension of the longitudinal axis of the workpiece spindle a displaceable tailstock 4 with a point is provided. On a cross slide which is fixed to the machine bed a grinding spindle stock with a grinding spindle is positioned, on which a grinding wheel 5 is attached. The grinding wheel 5 has a profile, with which the corresponding grooves are ground in the workpiece 1. To this end, the grinding wheel may be moved along CNC-axes in the X, Y and Z direction, and may be applied to the workpiece 1. Moreover, a crushing device 7 is provided, which carries a crushing roller. The axis of rotation of the crushing roller and of the grinding wheel 5 are parallel to each other, in any case when the grinding wheel 5 is subject to crushing of its profile.

Figure 2:
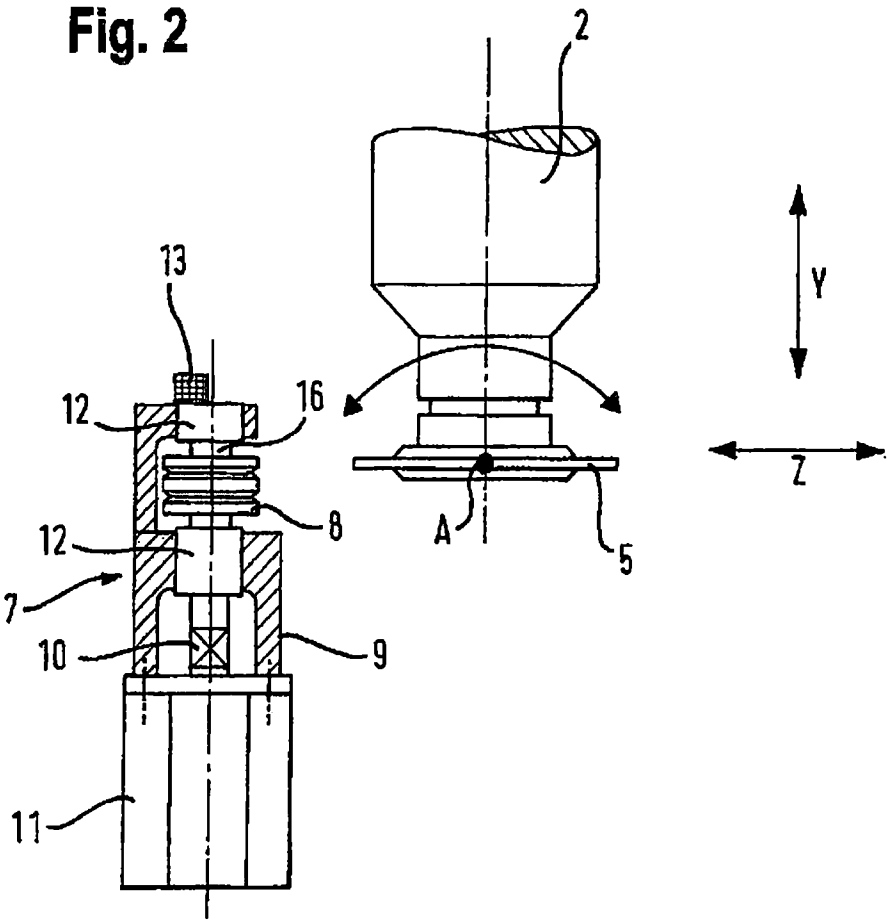
FIG. 2 shows a crushing device and associated grinding spindle with a grinding wheel according to the invention.

In FIG. 2 in the form of a detail of the arrangement of the grinding machine of FIG. 1 only the grinding spindle 2 with the grinding wheel 5 and the associated crushing device 7 with its crushing roller 8 are shown. In order to grind the corresponding grooves in the workpiece not shown in FIG. 2, the grinding spindle 2 is tiltable with its grinding wheel 5 around a CNC-controlled A-tilting axis. The grinding spindle may also be moved by CNC-control in the Z and Y direction.

The main structure of FIG. 2 of the crushing device 7 is characterized by a high rigidity, which is evidenced, for example, by the fact that the crushing device 7 is positioned inside a housing 9, in which the crushing spindle 16 holding the crushing roller 8 is rigidly supported on both sides of the crushing roller 8 by roll bearings 12. The drive motor 11 of the crushing device 7 is also CNC-controlled and is connected through a clutch 10 with the crushing spindle 16.

FIG. 2 shows a crushing roller 8, which has two crushing grooves or crushing slots. Both crushing grooves may be used in succession for crushing the profile of the grinding wheel 5. This can be, on one side, a profiling-crushing with the first crushing groove and a reshaping-crushing with the second crushing groove. However, it is also possible, that both crushing grooves of the crushing roller 8 are only used for reshaping-crushing. In this case, the crushing groove shown in FIG. 2 above is initially used for reshaping-crushing until it can no longer provide the required precision of profiling on the grinding wheel 5. Then the crushing groove shown below in the drawing is used for a further reshaping-crushing of the grinding wheel. When both crushing grooves are used for reshaping-crushing, the operating life of the crushing roller during crushing may be doubled with respect to a crushing roller with only one crushing groove. It is also possible that a higher number of crushing grooves are used or provided in the inventive crushing roller. In any case, with the inventive crushing roller, above all, also the higher rigidity can be considered, and a higher process precision during crushing of profile of the grinding wheel may be achieved, as well as a higher precision of workpieces to be grinded, if the at least two crushing grooves are positioned on an integral and therefore rigid crushing roller 8.

Figure 3:
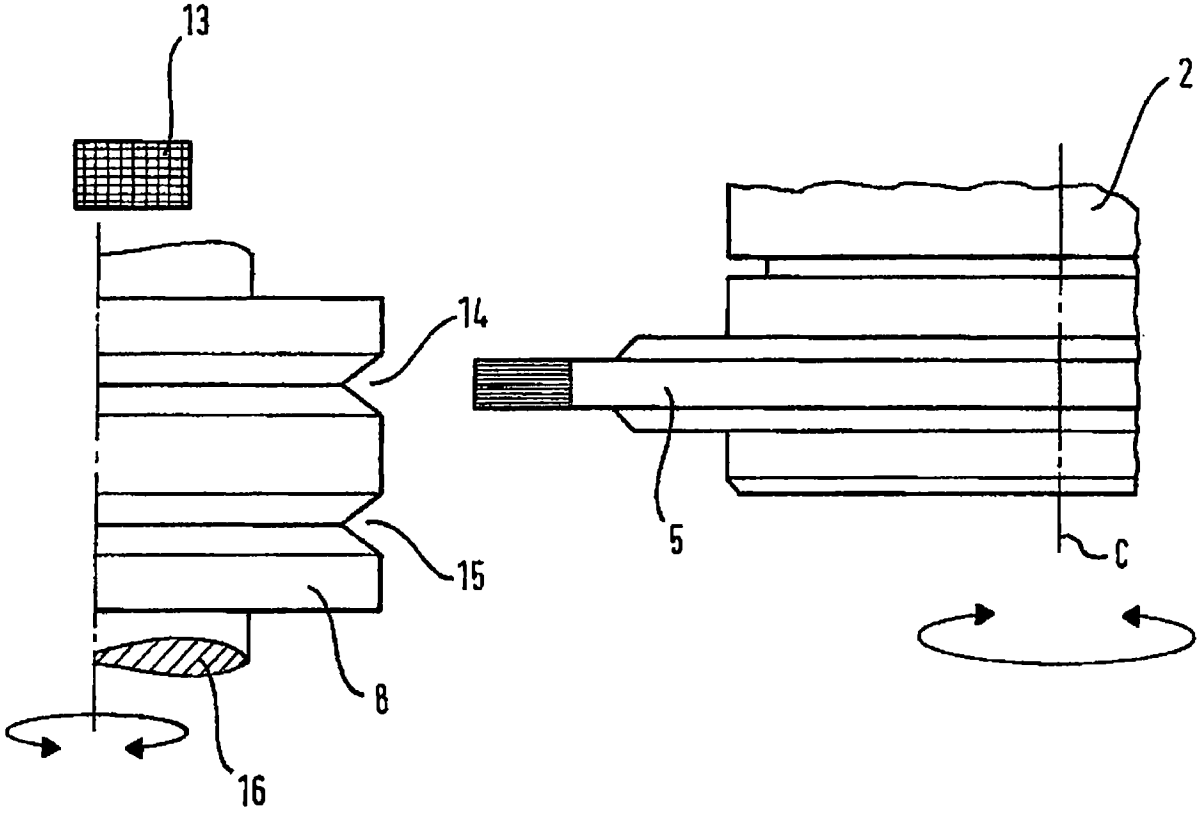
FIG. 3 shows a crushing roller with an associated grinding wheel for a profiling-crushing.

FIG. 3 shows only the main part of the crushing device 7, the crushing roller 8, which is positioned on the crushing spindle 16. The crushing roller 8 has a profiling-crushing portion 14 and a reshaping-crushing portion 15. Moreover, in principle, a body sound sensor 14 is provided on the crushing device 7, with which the engagement contact of the grinding wheel 5, which is positioned on the grinding spindle 2, and which is rotationally driven around its C-axis, and the crushing roller 8 may be detected or monitored.

The grinding wheel 5 shown in FIG. 3 is still not profiled and has therefore to be initially profiled-crushed for the actual grinding process. The term profiling-crushing means, in this context, the generation of the actual profile on the grinding wheel 5. This is performed in a profiling-crushing groove 15 provided for profiling-crushing on the crushing roller 8. To this end, the grinding wheel, which, prior to profiling-crushing is provided with a cross section deviating from the profile form, is initially applied on a flank of the profiling-crushing portion 14 of the crushing groove and slightly crushed. In the second step, a slight crushing is then performed on the second flank of the profiling-crushing groove 14. Then, the grinding wheel is moved at the center of the groove of the crushing roller, and both flanks are simultaneously profiled-crushed. After profiling-crushing, the grinding wheel is reshaped-crushed, wherein the grinding wheel obtains its final profile form with a very high precision.

The reshaping-crushing groove 15 also shown in FIG. 3 is on the contrary used only during the actual grinding process, when the profile of the grinding wheel 5 has to be reshaped-crushed, since its shape no longer corresponds to the nominal form and since its sharpness has to be re-sharpened.

The body sound sensor 14 reacts at each contact of the profile 6 to be produced of the grinding wheel 5 against one of flanks of the crushing grooves 14, 15 and therefore monitors the engagement contact during crushing. The initially flat trued grinding wheel 5 is then crushed by the profiling-crushing groove 14 of FIG. 3 in order to form a pointed profile, which is provided for thread grinding. Through separation of the crushing portions into a profiling-crushing portion 14 and a reshaping-crushing portion 15, due to the otherwise strong wear, which is normally experienced by the crushing roller 8, its life is extended. The reshaping-crushing groove 15 provided for reshaping-crushing ensures the generation of a profile 6 on the grinding wheel 5 for a highly precise forming of grooves in workpieces.

Figure 4:
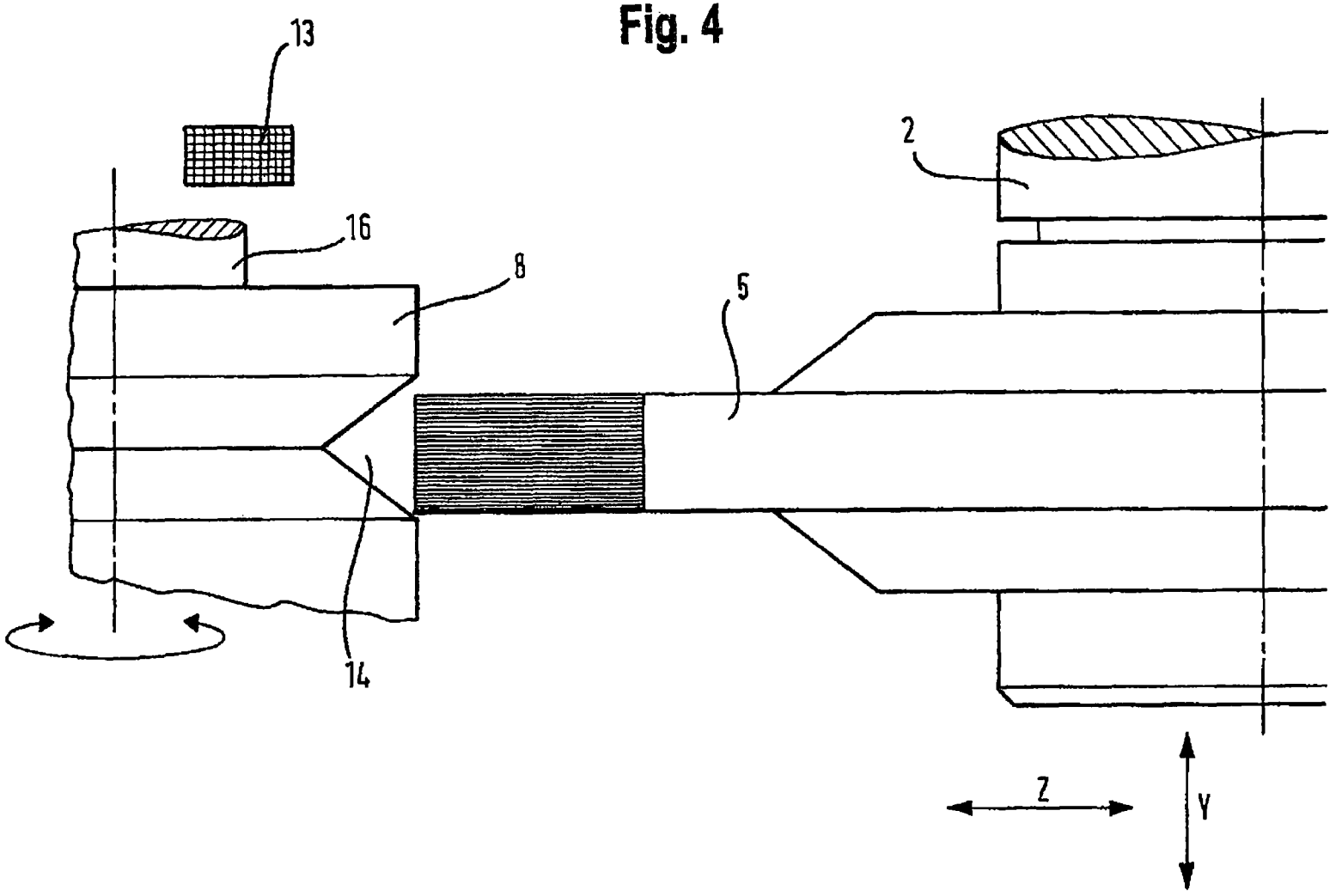
FIG. 4 shows a detailed view of the crushing roller and associated grinding wheel at the immediate start of the profiling-crushing, FIG. 5*a*) shows the crushing process of profile on the grinding wheel on a first flank, FIG. 5*b*) shows the crushing process of profile on grinding wheel of a second flank of the crushing roller, FIG. 5*c*) shows the crushing process, essentially at the end of crushing of profile on the grinding wheel by the crushing roller and FIG. 6) shows geometric relationships of groove depth and of peripheral surface provided for the groove depth in the groove and in the profile of the grinding wheel.

In the state shown in FIG. 4 of straight starting of crushing of trued grinding wheel 5, the latter is driven through its grinding spindle 2, whereby the not driven crushing roller 8 on the crushing spindle 16, due to engagement contact of the trued grinding wheel 5 in the profiling-crushing groove 14, the crushing roller is driven by the grinding wheel and moves with it. A separate drive for the crushing roller 8 does not occur, i.e. either the drive is deactivated, or the clutch 10 (FIG. 2) between drive and crushing roller is set to "separated". FIG. 4 also shows the body sound sensor 13, which records or monitors the engagement contact of grinding wheel 5 in the profiling-crushing portion 14. The signal generated by the sensor 13 in case of contact of grinding wheel 5 with crushing roller 8, represents the monitoring, that the grinding wheel 5 has actually formed a contact with the crushing roller 8 and starts the crushing process.

Since the grinding wheel 5 usually has a rounding error, the crushing roller 8 is not completely driven at first contact with the grinding wheel 5. Therefore, the speed of the crushing roller 8 may drop. If a predetermined lower speed threshold is reached, the drive motor 11 of crushing spindle 16 may be activated in a pulsed way. This activation takes place until the crushing roller 8 has again the speed of the grinding wheel 5. This means that the drive pulse is active until the crushing roller 8 has reached its nominal speed corresponding to the speed of the grinding wheel 5.

Figure 5B:
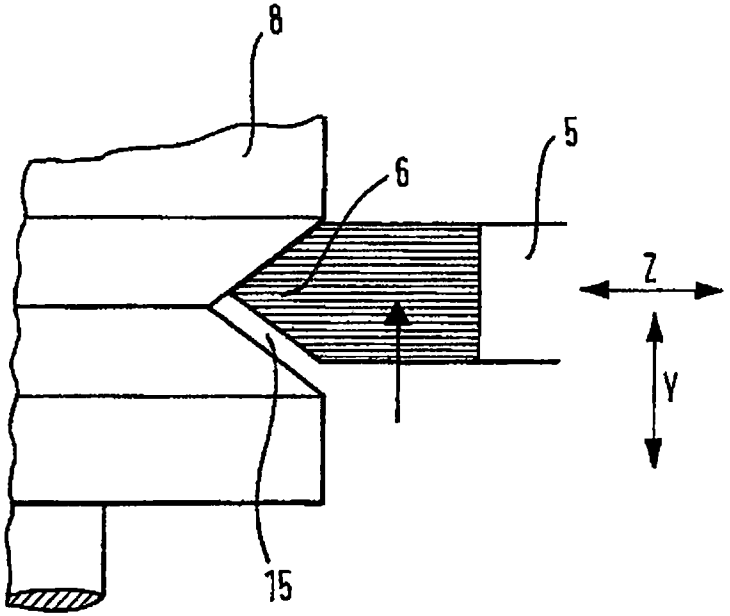
Figure 5A:
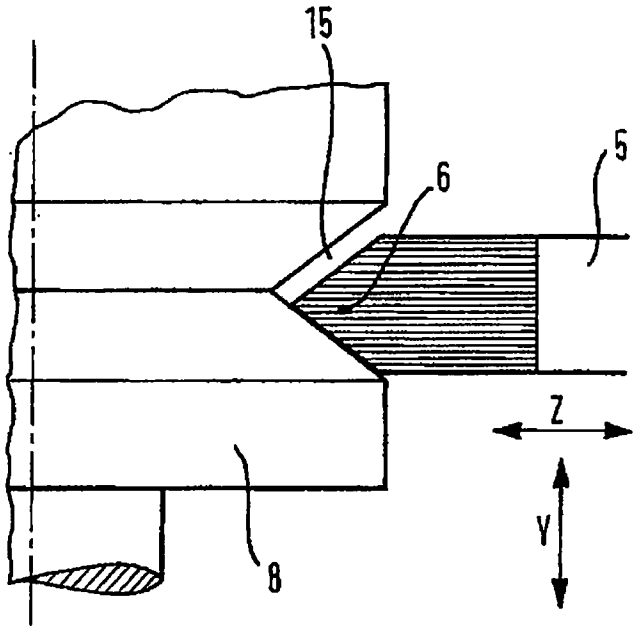

FIGS. 5*a*), *b*) and *c*) show different phases during crushing of profile 6 of grinding wheel 5. In general, during crushing, this procedure is followed, i.e. during profiling-crushing and reshaping-crushing. FIGS. 5*a*) to 5*c*) show examples of the reshaping-crushing process. FIG. 5*a*) shoes how initially a first flank of profile 6 of grinding wheel 5 is applied on a first flank of the reshaping-crushing groove 15 in the crushing roller 8 and slightly crushed. For achieving contact between the grinding wheel 5 and crushing roller 8 the grinding wheel 5 may be displaced along its CNC-controlled Z and Y axes. Thus, it is ensured that during crushing optimal crushing parameters regarding relative advancement, crushing forces and further parameters are maintained or obtained. FIG. 5*b*) shows how the laterally displaces grinding wheel 5 is applied with its flank opposed to the first flank of profile 6 on the second flank formed on the reshaping-crushing groove 15 and is subject in that position to the run-in process and slight crushing. Similarly to FIG. 5*a*) for the run-in of first flank, the grinding wheel 5 is displaced for application along its CNC-controlled Z and Y axes, in order to maintain the required and admissible crushing parameters.

Figure 5C:
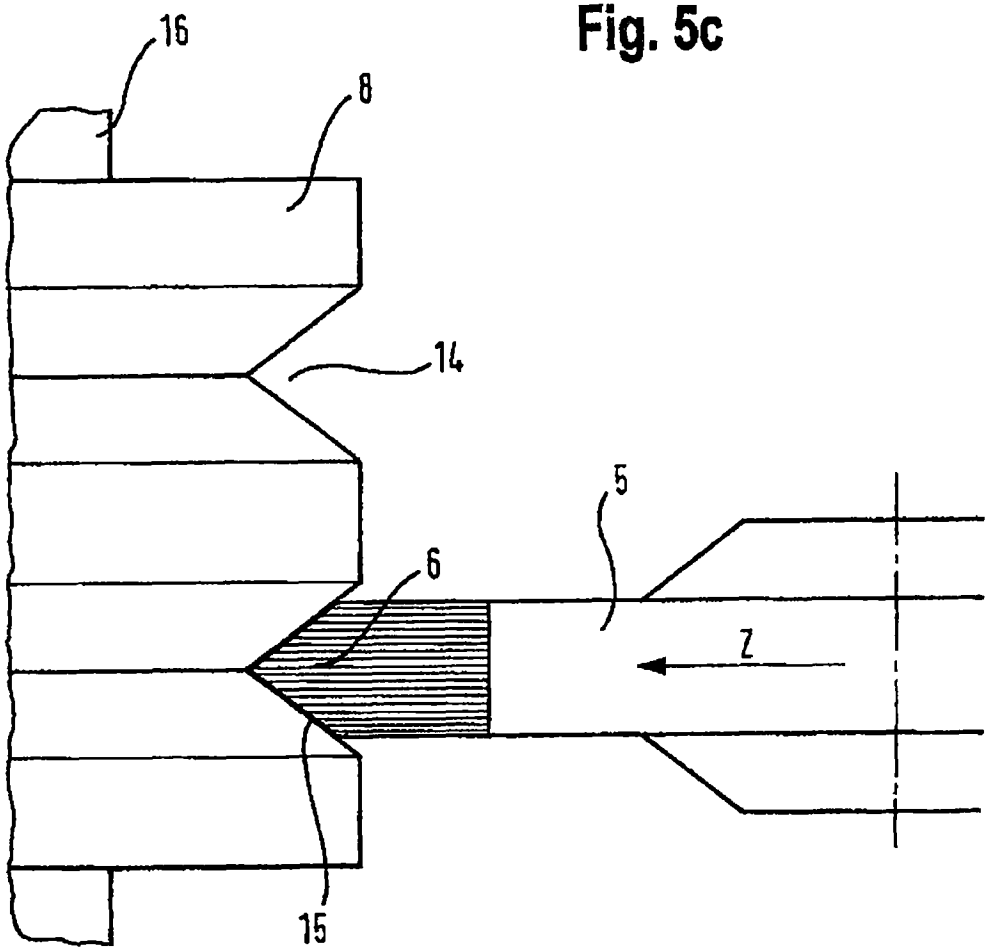

When both flanks of the profile 6 of the grinding wheel 5 have been individually applied and slightly crushed in the reshaping-crushing groove 15, the grinding wheel is moved in the Y direction, i.e. in the transversal direction, so that the profile is centrally positioned with respect to the crushing groove 15. This is shown in FIG. 5*c*). The simultaneous crushing of both flanks represents the last step of crushing of profile 6 of grinding wheel 5. In the present case, this is shown in the example of the reshaping-crushing. In the same manner, and with the same sequence, this is accomplished for the profiling-crushing by means of the profiling-crushing groove 14 of crushing roller 8 also shown in FIG. 5*c*).

Figure 6:
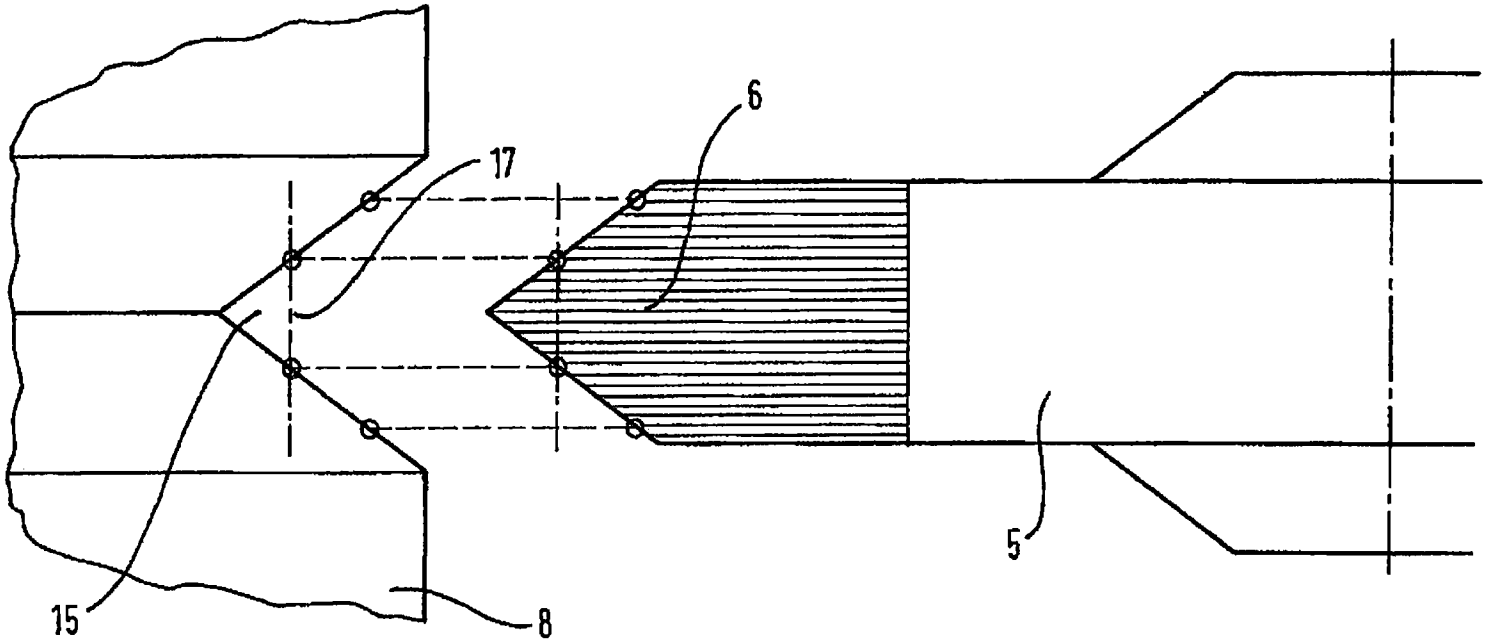

FIG. 6 shows the geometric relationships between the crushing groove 15 of crushing roller 8 and profile 6 of grinding wheel 5 in relation to two different planes with respect to the depth of the crushing groove 15. The reshaping-crushing groove 15 is also shown. Due to the fact, that both the grinding spindle and the crushing spindle are provided with individual separately controlled speed controls, it is possible to exactly define the "level" at which the peripheral speed of the crushing roller 8 and of the grinding wheel 5 have to be equal. It is to be noted that the grinding wheel 5 and the crushing roller 8 have different diameters. A "level" is in this case the annular peripheral surface 17. It is only a theoretical "level", indicated with reference to FIG. 6, in which this "level" is represented for a single radius. The corresponding radius extending up to the peripheral surface 17 inside the crushing roller 8 covers, so to speak, the annular, cylindrical peripheral surface 17. Considering the different diameter of the crushing roller 8 and of the grinding wheel 6, different speeds are obtained on the grinding wheel 5 of the crushing roller 8 so that with respect to a selected level, the speeds, i.e. the peripheral speeds are constant. The ratio of these peripheral speeds is therefore equal to 1:1. In case of in particular step-less displacement of this theoretical peripheral surface 17 during the crushing process, the quality of the profile 6 of the grinding wheel 5 may be further increased after the crushing process, whereby the result of grinding of workpiece may be improved.

LIST OF REFERENCES

1 workpiece
2 grinding spindle stock
3 workpiece spindle stock
4 tail stock
5 grinding wheel
6 profile of grinding wheel
7 crushing device
8 crushing roller
9 housing of crushing device
10 clutch of crushing device
11 drive of crushing device
12 roll bearing of crushing device
13 body sound sensor
14 profiling-crushing groove/profiling-crushing portion
15 reshaping-crushing groove/reshaping-crushing portion
16 spindle of crushing device
17 peripheral surface
18 machine control

The invention claimed is:

1. A method for grinding grooved workpieces with a profiling of a grinding wheel corresponding to the cross section of a groove, by means of which the groove is grinded in a workpiece clamped in the grinding machine, wherein the profiling of the grinding wheel is crush dressed, wherein a reshaping crushing process of the grinding wheel is performed by means of a crushing roller driven by the grinding wheel, wherein a control of the crushing process is performed depending on a measurement of rotational speed and current consumption of a drive of the grinding wheel and the crushing roller, and a relative advancement between the grinding wheel and the crushing roller during the crushing process is controlled on the basis of said measurement, characterized in that in the profiling-crushing process with a profiling-crushing portion of the crushing roller, a larger truing volume is removed from the grinding wheel by means of a reshaping-crushing portion disposed on the same crushing roller, than in a reshaping-crushing process.

2. The method of claim 1, characterized in that the profiling-crushing of the grinding wheel is performed by the crushing roller on the basis of measured rotational speed and current consumption of respective drives of the grinding wheel and the crushing roller by controlling the relative advancement between the grinding wheel and the crushing roller on the basis of said measurement, wherein the profiling-crushing is performed before starting a grinding process.

3. The method of claim 2, characterized in that for crushing, the grinding wheel is applied on the crushing roller and is engaged with the same, wherein during the profiling-crushing, the crushing roller freely rotates with the grinding wheel without having its own drive.

4. The method of claim 2, characterized in that a cooling medium is fed to the crushing roller and the grinding wheel during the crushing process, in respective engagement regions of the crushing roller and the grinding wheel.

5. The method of claim 2, characterized in that a maximum relative advancement between the grinding wheel and the crushing roller during crushing depends on grinding machine parameters and crushing parameters and is determined before crushing, and is inputted as a threshold value into a grinding machine control.

6. The method of claim 1, characterized in that during the profiling-crushing process, the grinding wheel is engaged with the crushing roller and the crushing roller freely rotates with the grinding wheel without having its own drive.

7. The method of claim 1, characterized in that a cooling medium is fed to the crushing roller and the grinding wheel during the crushing process, in respective engagement regions of the crushing roller and the grinding wheel.

8. The method of claim 1, characterized in that a maximum relative advancement between the grinding wheel and the crushing roller during a crushing process depends on grinding machine parameters and crushing parameters and is determined before crushing, and is inputted as a threshold value into a grinding machine control.

9. A grinding machine for grinding grooved workpieces, which is provided with a grinding spindle stock, which is movable, under CNC-control, on a cross slide over a machine support along the X-axis and Z-axis, which holds a grinding wheel and rotationally drives the same for grinding a groove, and a workpiece spindle stock with a C-axis, wherein the workpiece is held in a clamping by means of a workpiece spindle head, and a rigidly installed crush device comprising a crushing roller with a dedicated rotary drive is additionally provided, which may be controlled by a control device, wherein the grinding wheel and the crushing roller may be driven and their rotational speed may be adjusted during a reshaping-crushing process, characterized in that the grinding wheel is applied to the crushing roller in order to dress a profile of the grinding wheel and the crushing roller has a profiling-crushing portion for profiling-crushing the grinding wheel with a first dressing volume and a reshaping-crushing portion positioned on the same crushing roller, for reshaping-crushing the grinding wheel with a second dressing volume.

10. The grinding machine of claim 9, characterized in that the crushing device is positioned in a housing and is fixedly connected with the machine support.

11. The grinding machine of claim 10, characterized in that the crushing device has a CNC-controlled drive, which is connected, through a clutch, with the crushing roller, which is particularly made of high performance high speed cutting steel or hard metal, for its rotational drive.

12. The grinding machine of claim 10, characterized in that the crushing device has a body-sound sensor, by which, in case of the grinding wheel being engaged with the crushing roller, a signal may be sent to the control device, based on which the engagement contact between the crushing roller and the grinding wheel may be determined for its monitoring.

13. The grinding machine of claim 10, characterized in that the grinding wheel during the reshaping-crushing process, may be applied onto the crushing roller and may be moved in a transversal direction with respect to the reshaping-crushing portion.

14. The grinding machine of claim 10, characterized in that at the beginning and/or during the profiling-crushing, the drive of the crushing device may be provided with drive pulses in case of a speed drop.

15. The grinding machine of claim 10, characterized in that the crushing roller is in one or two parts.

16. The grinding machine of claim 10, characterized in that the control device is adapted so that a maximum relative advancement between the grinding wheel and the crushing roller during a crushing process is smaller than a predetermined threshold value, which depends on the machine parameters and process parameters, and which may be input into the control device before starting the crushing process.

17. The grinding machine of claim 9, characterized in that the crushing device has a CNC-controlled drive, which is connected with the crushing roller for its rotational drive through a clutch, which is particularly made of high performance high speed cutting steel or hard metal.

18. The grinding machine of claim 9, characterized in that the crushing device has a body-sound sensor, by which, in case of the grinding wheel being engaged with the crushing roller, a signal may be sent to the control device, based on which the engagement contact between the crushing roller and the grinding wheel may be determined for its monitoring.

19. The grinding machine of claim 9, characterized in that the grinding wheel during the reshaping-crushing process, may be applied onto the crushing roller and may be moved in a transversal direction with respect to the reshaping-crushing portion.

20. The grinding machine of claim 9, characterized in that at a beginning and/or during a profiling-crushing, the drive of the crushing device may be provided with drive pulses in case of a speed drop.

21. The grinding machine of claim 9, characterized in that the crushing roller is in one or two parts.

22. The grinding machine of claim 9, characterized in that the control device is adapted so that a maximum relative advancement between the grinding wheel and the crushing roller during a crushing process is smaller than a predetermined threshold value, which depends on the machine parameters and process parameters, and which may be input into the control device before starting the crushing process.

* * * * *